United States Patent [19]

Rainey

[11] Patent Number: 5,042,614

[45] Date of Patent: Aug. 27, 1991

[54] ADAPTABLE HUNTING STAND FOR LADDER-LIKE USE OR A-FRAME USE

[76] Inventor: Robert P. Rainey, P.O. Box 307, Atkins, Ark. 72823

[21] Appl. No.: 592,848

[22] Filed: Oct. 4, 1990

[51] Int. Cl.[5] ..... E06C 5/00; A45F 3/26

[52] U.S. Cl. ..... 182/22; 182/119; 182/127; 182/178

[58] Field of Search ..... 182/127, 178, 22, 118, 182/119; 403/290, 234, 235

[56] References Cited

U.S. PATENT DOCUMENTS

| | | | |
|---|---|---|---|
| 1,072,378 | 9/1913 | Bauschlicher | 403/290 |
| 3,144,178 | 8/1964 | Sarnoff | 403/290 |
| 3,476,211 | 11/1969 | Cormier | 182/178 |
| 4,060,150 | 11/1977 | Hughes | 182/178 |
| 4,614,252 | 9/1986 | Tarner | 182/127 |
| 4,625,831 | 12/1986 | Rodgers, Jr. | 182/127 |
| 4,696,374 | 9/1987 | Hale | 182/127 |
| 4,787,477 | 11/1988 | Dolan | 182/127 |
| 4,800,986 | 1/1989 | Hayes, III | 182/127 |

*Primary Examiner*—Reinaldo P. Machado
*Attorney, Agent, or Firm*—Jerome A. Gross

[57] ABSTRACT

Interactive component parts for assembling an ATV-mounted hunting stand of either the "A"-frame type or tree-leaning type, or alternatively as a ground-standing tree-leaning hunting stand. It includes a leveling seat platform, ladder elements, quick-grasping base connector assemblies, and a ground support. The seat platform has angularly-adjustable sockets so sized as to fit onto the upper ends of ladder elements, whose lower ends may have sleeves to allow these ladder elements to be mounted atop other ladder elements. Base connector sleeve assemblies allow ladder elements to be quickly and easily mounted on and demounted from rods attached to an ATV; they are free to pivot about these rods. When such ladder elements are so mounted on an ATV as an A-frame hunting stand, changing the angularity of the seat sockets effects seat leveling. For ground-standing ladder use, a broad ground support may be inserted into the lowest ladder element.

10 Claims, 2 Drawing Sheets

FIG. 1
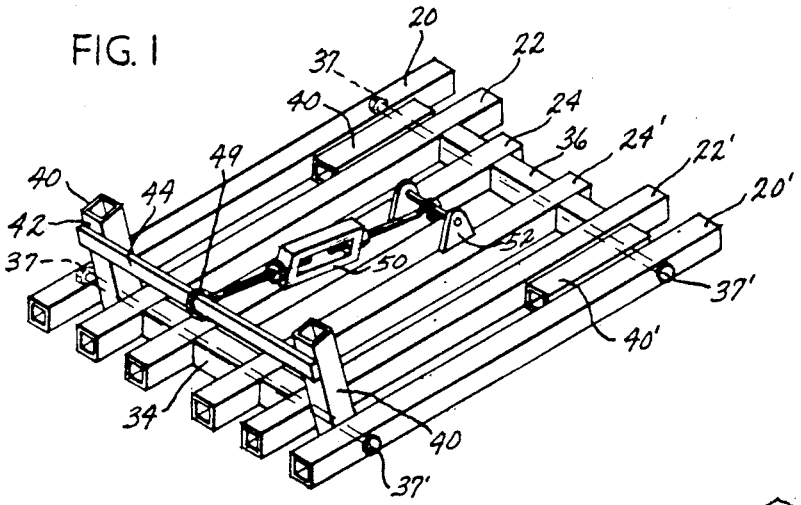
FIG. 2
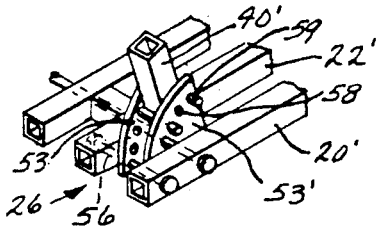
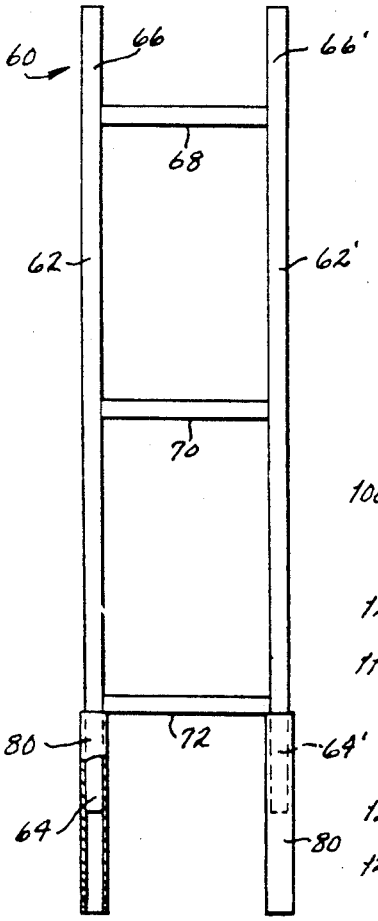
FIG. 3
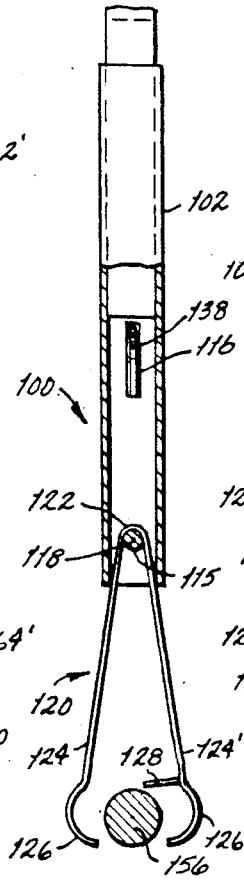
FIG. 4
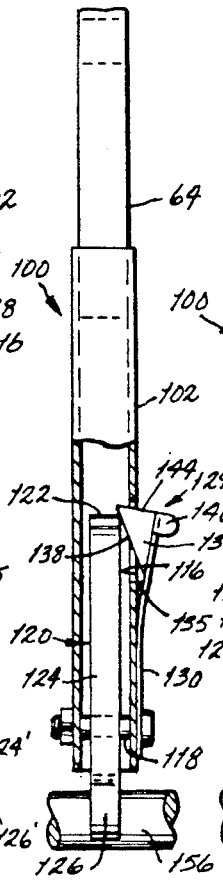
FIG. 5
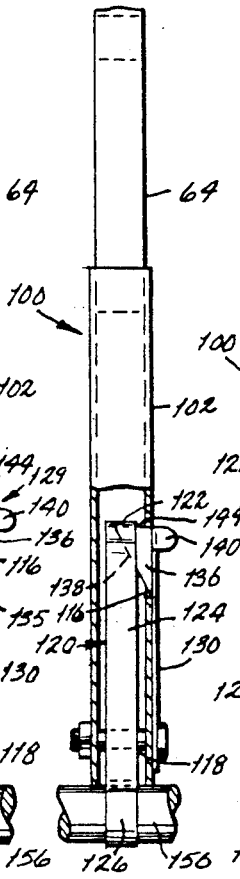
FIG. 6
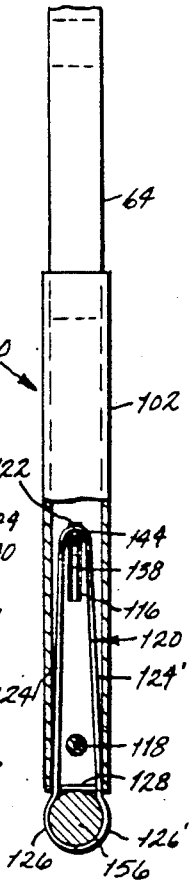
FIG. 7

ADAPTABLE HUNTING STAND FOR LADDER-LIKE USE OR A-FRAME USE

BACKGROUND OF THE INVENTION

1. Field of the Invention

This invention relates to a sectional hunting stand, adapted for ladder-like use or for A-frame use when mounted on an all terrain vehicle.

2. Description of Related Art

Elevated observation stands, providing a hunter secure seating and a wide visual range, are desirable when hunting deer and other game in forested areas, fields, and reforesting areas. The relatively easy access to these areas now provided by all terrain vehicles (ATVs) has encouraged the development of such stands to be used while mounted on ATVs.

Such de-mountable stands known to the inventor are of two major types. One such type, described in U.S. Pat. No. 4,800,986 to Hayes, and U.S. Pat. No. 4,787,477 to Dolan, requires front and rear leg members which create a modified "A" frame to support a seating platform between the leg members.

A second type, disclosed in U.S. Pat. No. 4,614,252 to Tarner, and U.S. Pat. No. 4,625,831 to Rodgers shows, mounted on an ATV, a single ladder element whose attached seat platform abuts a tree for fixed support.

The seating platforms of such stands have heretofore been fixed and unadjustable as to their angularity. The patent to Hayes appears capable of limited adjustment at what appears to be some sacrifice of stability.

SUMMARY OF THE INVENTION

The purposes of the present invention are to provide a hunting stand which: allows the angle of its seat platform to be adjusted to level the seat relative to the slope of the terrain; provides, by differing simple assembly of its elements, a high or low "A"-frame type stand, and a variable height single ladder stand which may be either ATV mounted or ground-standing and leaned against a tree; and which mounts and dismounts easily from rods affixed fore and aft on an ATV. Such purposes are achieved by use of the interactive parts (seat platform, ladder elements, and base connectors) of the present invention, each hereinafter described.

The seat platform of the present invention is comprised of elongated parallel members, spaced apart and running from front to back. The length of the parallel members at the seat platform back is symmetrically graduated from longer outer members to shorter inner members, forming an inwardly curved seat back adapted to fit against a tree.

Two pairs of downwardly projecting pivotable sockets, one pair provided at the seat front and one pair at the seat back, may be adjusted and fixed at a chosen angle relative to the seat platform. The seat sockets are so sized as to fit over the upper side rails of the ladder elements of the present invention.

Each ladder element of the present invention has three rungs attached to ladder sidepieces which extend higher than the highest rung and lower than the lowest rung. The ladder elements are so constructed that they are fittable onto each other, so that in combination they may form A-frame and single-ladder stands of varying heights.

Chosen ladder elements are equipped at their bases with novel grasping connectors, by which the ladder element may easily be manually mounted and demounted from bars affixed to an ATV. The connectors attach so as to allow the ladder element to pivot on these bars to accommodate various angles of the ladder sections resulting from insertion into the fixed-angle seat sockets.

BRIEF DESCRIPTION OF THE DRAWINGS

FIG. 1 is an isometric view of the underside of a leveling seat platform constructed from elongated parallel members whose sockets at the seat front are interconnected so as to be angularly adjustable by turnbuckle means, and whose sockets at the seat back are shown folded between the elongated parallel members.

FIG. 2 is a fragmentary view of a seat platform somewhat modified from FIG. 1, showing sector plates fitted with pins to adjust the angles of the sockets relative to the seat platform.

FIG. 3 is a view of a typical ladder element with its lower sidepiece ends inserted in simple sleeves, the left sleeve being shown partially broken away.

FIG. 4 is a partially broken-away side view of a base connector sleeve whose downwardly-extending uncompressed bent spring extends outward from, but is retained within the sleeve by a retention bolt, and whose grasping ends are positioned outward of a graspable rod on an ATV, shown in phantom lines.

FIG. 5 is a broken front view of the base connector sleeve of FIG. 4, whose sleeve is being driven downward so that the diagonal edge of its camming blade contacts the outer side of the bend of the bent spring, driving the blade outward.

FIG. 6 is a broken front view, similar to FIG. 5, showing the bent spring of the connector sleeve in its final grasping position with the sleeve driven fully downward about it so that the inner side of the bend of the bent spring is engaged by the top edge of the blade.

FIG. 7 is a side view of the base connector sleeve in position corresponding to FIG. 6.

DESCRIPTION OF THE PREFERRED EMBODIMENT

Figure 8:
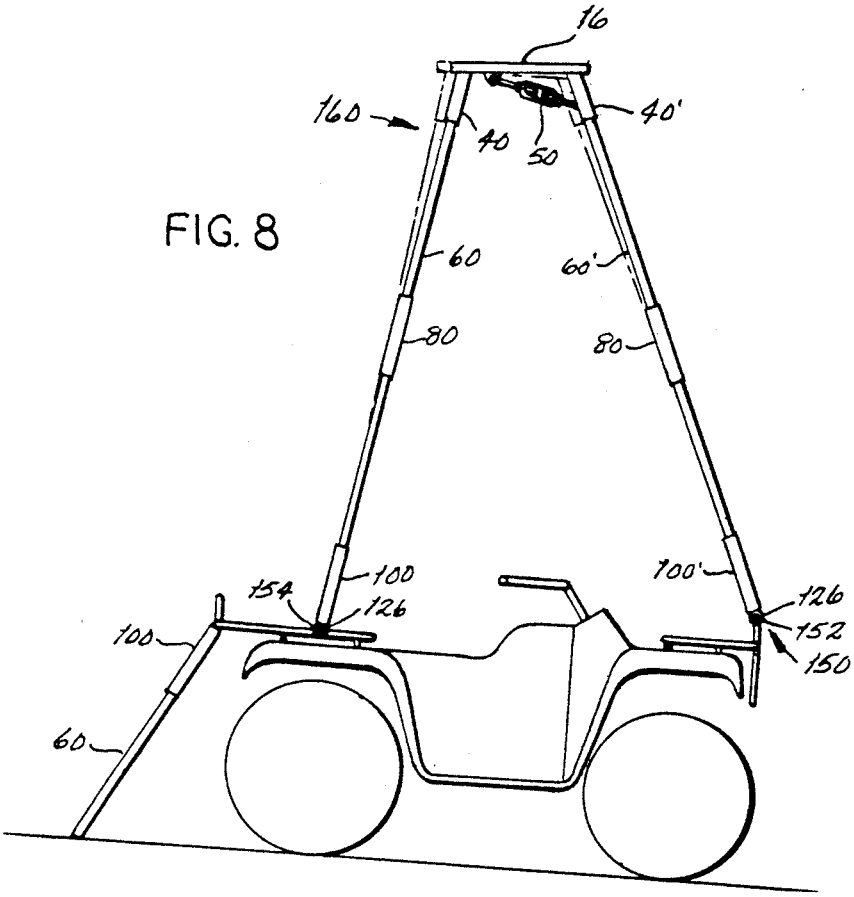
FIG. 8 is a side view of such a leveling seat platform mounted for low A-frame use atop opposite ladder elements attached by base connector sleeves onto an ATV, the angle of the seat platform having been adjusted to compensate for downward slanting terrain, and a ladder element used as a stabilizer.

The present invention provides component parts which may be used to assemble an ATV-mounted A-frame hunting stand of different chosen heights whose seat platform may be leveled to compensate for hilly terrain on which the ATV may be parked; these component parts may also be used to assemble a single-ladder hunting stand of different chosen heights which may be either ATV-mounted or ground-standing. The component parts of the present invention are: a leveling seat platform, ladder elements, and easily mountable grasping base connector assemblies.

The seat platform 16 of the present invention, whose underside is shown in the isometric view of FIG. 1, is constructed of two outer elongated members 20, 20', two intermediate elongated members 22, 22' of length identical to the outer members 20, 20', and two shorter inner members 24, 24', all made from square metal tubing, and running spacedly parallel to each other from a seat platform front, generally designated 26, where their ends are evenly aligned, to a seat platform back, generally designated 28, where the two shorter inner members 24, 24' terminate inwardly of the intermediate members 22, 22' and outer members 20, 20', creating an inset adapted to fit against a tree trunk.

The inner elongated members 22, 22' and the intermediate elongated members 22, 22' are held uniformly apart by spacers 38 at both the seat front 26 and at the seat back 28; the intermediate elongated members 22, 22' and the outer elongated members 20, 20' are held similarly apart both at the seat front 26 and seat back 28 by hollow pivotable sockets 40, 40'. The elongated members 20, 20', 22, 22', 24, 24' are cross-drilled and connected, spacedly inward of the seat front 26, by a front cross-rod 34, and, spacedly inward of the seat back 28, by a back cross-rod 36, each rod 34, 36 extending through the separating spacers 38, 38' and sockets 40, 40' and secured by a nut 37, 37' at the outermost walls of the outer elongated members 20, 20'.

The pivotable hollow sockets 40, 40' at the seat front 26 are connected, as shown in FIG. 1, by a bar 44 extending between and welded to the front outer faces 42, 42' of the sockets 40, 40'. A screw adjustment turnbuckle 50 is connected to the bar 44 by an eye 49 and extends under the seat platform 16 to a bracket 52 mounted between the inner elongated members 24, 24', and located between the seat front 26 and back 28. Adjustment of the turnbuckle 50 fixes the angle of the sockets 40, 40' relative to the seat platform 16 thereby allowing it to be leveled relative to the terrain. Optionally, a second turnbuckle may extend from a similar bracket to a similar connected bar welded to the outer faces 42, 42' of the pair of sockets 40, 40' at the seat platform back 28.

An alternate construction for leveling the seat platform 16 is shown in fragmentary view in FIG. 2. Between outer elongated members 20, 20', and the intermediate elongated members 22, 22' on either side of each of the hollow sockets 40, 40', are mounted a pair of 90° sector plates 53, 53', the distance between the members 20, 20', 22, 22', so being increased as to accommodate the width of the plates. At their 90° intersections, the plates 53, 53' are mounted on the front cross-rod 34, and the curved outer edge of each of the plates 53, 53' is mounted on cross-bolts 56, 56' extending between the outer elongated members 20, 20' and the inner elongated members 22, 22' immediately inward of the seat platform front 26. Inwardly of the curved edge of each plate 53, 53' is a plurality of cross bores 58, 58' in identical arcuate patterns through which detent pins 59, 59', may be inserted on at least the outer sides of each socket 40 to limit its rotational movement and thereby fix the angle of the sockets 40, 40' relative to the seat platform 16.

All sockets 40, 40' are hollow and have identical interior width and depth and are so sized that they may receive the upper ends of the sidepieces 66, 66' of the ladder element 60 hereinafter described.

Each ladder element 60, as illustrated in FIG. 3, is constructed of square metal tubing and has at least three rungs, an uppermost rung 68, an intermediate rung 70, and a lowermost rung 72 extending between parallel sidepieces 62, 62' of constant cross-section. The sidepieces 62, 62' extend higher than the uppermost rung 68 and lower than the lowermost rung 72. Upper sidepiece ends 66, 66' of a ladder element 60 may be fitted into the pair of sockets 40, 40' at the front 26 or back 28 of the seat platform 16. At the lower end of each sidepiece 64, 64' a hollow sleeve 80 of constant cross-section having interior width and depth identical to the width and depth of the seat platform sockets 40, 40' enabling a slidable fit between the sleeve 80 and an upper sidepiece end 66 is fitted on, and alternately may be welded onto each ladder lower sidepiece end 64, 64' to extend as shown in the broken cross-section of FIG. 3, from the lowermost ladder rung 72 to substantially beyond the lower sidepiece ends 64, 64'.

Upper sidepiece ends 66, 66' of a ladder element 60 may be fitted into the downward-extending sleeves 80, 80' of an identical ladder element 60'; two or more of such ladder elements 60, 60' may thereby combine to form ladder sections 76 as hereinafter described and illustrated in FIG. 9.

The present invention contemplates the use of a plurality of ladder elements 60, all but two being fitted with the hollow sleeves 80, just described, these two being fitted with grasping base connector assemblies 100, hereinafter described.

For ATV-mounted use, the novel grasping base connector assemblies 100 of the present invention secure a hunting stand hereinafter described and illustrated in FIG. 8 as 160, assembled from a seat platform 16 and ladder elements 60, 60', to transverse, graspable front rods 152 and rear rods 154 mounted on an ATV 150. As illustrated in FIG. 4, each connector assembly 100 includes a hollow, rectangular sleeve-like member 102 fitted with a bent spring 120, a retention bolt 118 and latching means 129.

The sleeve-like member 102 is of constant cross-section, and its interior width and interior depth are identical to those of a connecting sleeve 80 and a seat platform socket 40. Outer walls of the sleeve-like member contain bolt-accommodating holes 115, 115', spacedly above the sleeve open lower end, and one outer wall contains spacedly above a bolt-accommodating hole 115 a vertical slot 116, hereinafter referred to.

The bent spring 120 is formed from metal narrower than the interior width of the sleeve-like member 102. It has a central bend 122 permanently set at an angle of less than 90°. From its bend 122 two opposing arms 124, 124' extend, each arm terminating in an opposing curved grasping portion 126, 126'. At the juncture between one arm 124' and its grasping portion 126' a stop 128 extends perpendicularly inward toward the opposing arm 124.

The spring is mounted by inserting its central bend 122, as shown in FIG. 4, into the open lower end of the sleeve-like member 102 beyond the bolt holes 115, 115'; it is there retained by insertion of the bolt 118 through the bolt holes 115, 115'. As long as the spring 120 is uncompressed, its grasping portions 126, 126' are spread more widely than the diameter of the rod hereinafter described.

In order to secure the bent spring 120 in a retracted compressed position within it, the sleeve-like member 102 is fitted with releasable latching means 129. A preferred latch, illustrated in FIG. 5, includes the vertical slot 116 through the sleeve-like member outer wall 106, a flat spring 130, and a camming blade 136 which may enter the sleeve-like member 102 through the slot 116 so that its top edge will extend horizontally into the sleeve-like member interior width. The lower end of the flat spring 130 is secured to the sleeve-like member outer wall 106 by the retention bolt 118.

The camming blade 136, shown cammed outward in FIG. 5, has a diagonal cam edge 138 whose lead angle may be approximately 30° from the flat spring 130, and a perpendicular top edge 144. The blade 136 may be formed integrally with the flat spring 130 by bending it perpendicular to one edge of the flat spring 130; a projecting release tab 140 may be bent perpendicularly outward from its other edge. The camming blade 136 may enter the sleeve-like member 102 through the slot 116 in the sleeve-like member outer wall, so that its top edge 144 extends horizontally into the sleeve-like member interior width.

Such grasping connector sleeve assemblies 100 are slidably fitted on, or welded onto, the lower sidepiece ends 64, 64' of those ladder elements 60 which are to be mounted on an ATV equipped with fore-and-aft mounted transverse rods 152, 154 respectively.

Referring to FIGS. 4 through 7, the curved grasping portions 126 of the uncompressed bent spring 120 of a connector 100 are positioned about an ATV-mounted rod 156. As shown in FIG. 5, downward movement of the sleeve-like member 102 toward the rod 152 compresses the bent spring 120, as the spring central bend 122 travels relatively upward into the sleeve-like member 102 to contact the diagonal edge 138 of the camming blade 136, forcing the blade 136 outward through the slot 116, to allow the spring central bend 122 to pass above the blade top edge 144. As the central bend 122 so passes, the flat spring 130 returns the camming blade 136 to within the sleeve-like member 102, the blade top edge 144 now being beneath the spring central bend 122, as shown in phantom in FIG. 6, thus to retain the bent spring 120 in compressed position so that its curved grasping portions are secured about the rod 152, as shown in side view in FIG. 7.

Demounting of the ladder element 60 is accomplished by manually pulling the release tab 140 outward, thereby moving the camming blade 136 outward through the slot 116 and releasing the bent spring 120. The sleeve-like member 102 may then be raised to permit the bent spring 120 to spread and release the bar 156.

The low A-frame hunting stand 160 illustrated in FIG. 8 shows the leveling seat platform 16 mounted atop opposing ladder elements 60, 60', the seat platform sockets 40, 40' at the seat front 26 fitted over the upper sidepiece ends 66, 66' of a ladder element 60, and the sockets 40, 40' at the seat back 28 fitted over the upper sidepiece ends 66, 66' of the opposing ladder element 60'. The grasping base connector assemblies 100, 100' affixed to the lower sidepiece ends 64, 64'αof the opposing ladder elements 60, 60' rotatably secure the stand 160 to transverse rods 156, 156' installed on the ATV 150.

The seat platform 16 may be leveled relative to sloping terrain on which the ATV 150 may be parked; this is done by adjustment of the turnbuckle 50 to fix the angle of the seat platform sockets 40, 40' relative to the seat platform 16. FIG. 8 illustrates in phantom lines the angularity of the seat platform 16 and ladder elements 60 prior to such adjustment, and in solid lines, their angularity after adjusting. The curved grasping portions 126, 126' of the connector assembly may pivot on the rods 152, 154 to accommodate the chosen angle of the sockets 40, 41 and ladder elements 60, 60' inserted therein.

The embodiment illustrated in FIG. 8 shows two ladder elements 60, 60', on each side of the seat 16. The height of the stand may, as should be obvious, be increased by interpositioning a third ladder element 60, 60' on each side.

A single ladder hunting stand, not shown, may be assembled by mounting a single ladder element 60 or a ladder section 76 of two or more ladder elements 60, 60' onto the forward rods 152 of the ATV 150. The seat platform 16 may then be mounted atop the ladder upper sidepiece ends 66, 66' by the sockets 40, 40', on the seat front 26 and the inset seat back 28 leaned against a tree trunk.

To brace the ATV 150 against deflection when such a stand is climbed on, a ladder element 60 fitted with grasping base connector assemblies 100, 100' may be attached, as shown in FIG. 8, to the rod of an ATV rack assembly which extends beyond the ATV fender, and so rotated as to contact the ground.

Figure 9:
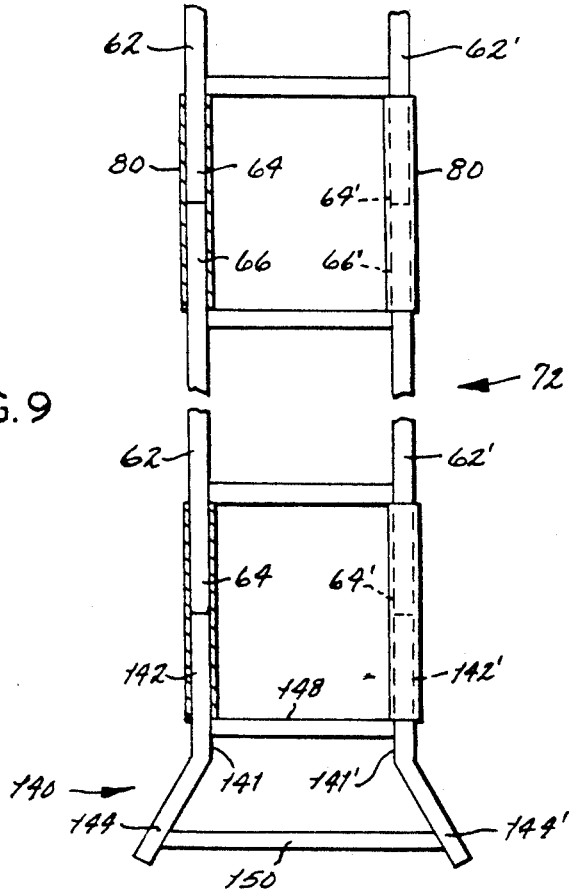
FIG. 9 is a view, principally from the front, of a ground support fitted within the sleeves of a ladder element.

For use independent of an ATV, a ladder element or elements 60 may be erected on the ground support 140, made of square metal tubing and illustrated in FIG. 9. It includes two side rails 141, 141', each having a vertically extending portion 142 of the same exterior width and depth as the interior width and depth of a connecting sleeve 80, and an outward and downward extending leg 144. The side rails 141, 141' are connected between their vertically extending portions 142, 142' by an upper rung or rungs 148 and between their outward extending legs 144, 144' by a longer lower rung 150.

To assemble a single ladder ground stand, not shown, a ladder element 60 or a ladder section 72, having lower sidepiece ends 64, 64' fitted with connecting sleeves 80, may be mounted atop the ground support vertically extending members 142, 142', as shown in broken view in FIG. 9. The seat platform 16 may then be mounted and leaned against a tree as for the ATV-mounted single ladder stand previously described.

As various modifications may be made in the constructions herein described and illustrated without departing from the scope of the invention, it is intended that all matter contained in the foregoing description or shown in the accompanying drawings shall be taken as illustrative rather than limiting.

What is claimed is:

1. For use atop a ladder element having side rails projecting higher than the highest rung, a leveling seat platform having, at one or both of its ends, a pair of pivotable sockets, sized to accept such upwardly projecting side rails, together with angular adjustment means operable between said seat platform and said sockets to permit leveling of said seat platform, whereby to compensate for the angle of slope of such ladder element.

2. A leveling seat platform as defined in claim 1, in which said angular adjustment means comprises opposing plate-like members fixedly attached adjacent to said sockets and in planes parallel to that in which said sockets may pivot, said members having a plurality of holes spacedly arranged in a generally arcuate pattern about the axis of pivoting of said sockets, and removable detent pins, insertable through and operable between and said plates, whereby said sockets may bear against said detent pins at a chosen angle of such adjustment.

3. A leveling seat platform as defined in claim 1, in which said angular adjustment means comprises means connecting the angle of pivoting of said sockets with each other, together with a screw-adjustable length member having one of its ends affixed to said interconnecting means, and the other of its ends affixed to seat platform structure remote therefrom.

4. A leveling seat platform as defined in claim 1, wherein said seat platform includes a plurality of parallel elongated members extending spacedly apart from front to back, and connected by a cross-rod, said sockets being pivotally mounted on said cross-rod between the outermost of said members and those members immediately adjacent thereto, said sockets being so sized as to fit pivotally between said elongated members, whereby to permit the folding of said sockets therebetween.

5. For use as the platform member of a single ladder tree stand, a seat platform as defined in claim 4, in which the lengths of said elongated members along the seat platform back are symmetrically graduated from longer outer members to shorter members therebetween, whereby said seat platform is adapted to fit against a tree trunk.

6. A base connector for graspable attachment comprising a substantially rigid hollow rectangular sleeve of constant cross-section, in combination with a retention bolt extending thereacross, a bent spring formed from flat metal narrower than and fittable within said sleeve hollow, and having two downward-extending arms connected by a central bend of normally less than 180°, said spring bend being positioned above said retention bolt, whereby said bent spring when uncompressed extends its arms wider than said sleeve hollow, and downward movement of said sleeve relative to said spring bend comprises its arms toward each other, said arms terminating in grasping portions, and at least one of said arms further having a stop at the inward extremity of said grasping portion, said connector further including releasable spring latch means, operable by downward movement of said sleeve relative to said spring bend, to retain said spring in such position that only its grasping portions project below said bottom opening of said sleeve, whereby on placing said spring grasping portions about a graspable base and moving said sleeve downward toward such base, said spring arms are pressed toward each other, and said grasping portions releasably engage such base.

7. A base connector as in claim 6, wherein said spring latch means comprises an opening in said sleeve located above said sleeve bottom at a height substantially corresponding to the length of said spring arm between said central bend and said grasping end, a pin having a tapered, downward facing camming surface, and a flat spring, secured at one end onto the outer wall of said sleeve, bearing said pin perpendicularly on its unsecured end, and normally projecting said pin inwardly through said opening to extend within the sleeve parallel to and above said retention bolt, whereby downward movement of said sleeve relative to said bent spring causes said bend to engage said downward facing camming surface of said pin, and project said pin outward sufficiently to permit said spring bend to pass upward beyond said pin, whereupon said pin is returned inward by said flat spring to retain the bend of said spring in such retracted position.

8. A vehicle mounted hunting stand adaptable for "A"-frame or single-ladder tree stand use, such vehicle having a graspable base element comprising a plurality of ladder elements, each element having two parallel sidepieces of constant cross-section and a plurality of rungs, each sidepiece projecting above the highest said rung and below the lowest said rung, in combination with a hollow sleeve of constant cross-section fitted to and extending downward from each ladder element lower sidepiece end, those sleeves to be used immediately on such vehicle being fitted with vehicle grasping base connectors, said stand further comprising a seat platform having two pairs of sockets of the same hollow cross-section of said sleeves, each pair being fittable downwardly about the upper ends of one of said ladder elements of the same hollow cross section of said sleeves, whereby two opposing ladder sections, each comprising one or more such ladder elements, may form an "A"-frame stand by the interfitting of their uppermost sidepiece ends into said seat platform sockets and attaching their lowermost sleeves to such vehicle graspable base element; and alternatively, said ladder sections may be mounted atop each other, and said seat mounted, by one pair of said seat platform sockets on said uppermost ladder section thereof, and said lowermost sleeve to such vehicle graspable base element to form a single ladder tree stand of twice the height of such "A"-frame stand.

9. A ladder element terminating in downward extending sleeves as defined in claim 8, in combination with a stabilizing ground support, said support comprising a vertical member fittable upwardly within each of said sleeves, said members being mounted atop downward and outward extending legs having stabilizing means therebetween, said legs terminating in ground contacting ends, whereby fitting said vertical members into said sleeves adapts the bottom of said ladder element to rest securely on the ground for use as a tree stand.

10. An adaptable hunting stand for either ladder-like or A-frame use, comprising A. a leveling seat platform, said platform including a plurality of parallel elongated members extending spacedly apart from front to back and connected by two cross rods, the length of said members being symmetrically graduated along said seat platform back, from the longer outermost of said members to the shorter innermost of said members therebetween, whereby to form a seat platform back shaped to fit against a tree, said seat platform further having sockets pivotally mounted on said cross rods between said outer members and said members inwardly thereof, together with means for adjusting the angular relationship between said sockets and said seat platform, said stand further comprising a plurality of ladder elements, each element having two parallel sidepieces of constant cross-section and a plurality of rungs, each sidepiece projecting higher than the highest of said rungs and lower than the lowest of said rungs, each element further having a hollow sleeve of constant cross-section fitted to and extending from each of said lower sidepiece ends, whereby said sleeves of a ladder element may be fitted over and upon the upper sidepiece ends of another ladder element, the said sleeves of two selected ladder elements having grasping base connector means mounted in the lower ends of their said hollows, each said grasping base connector means comprising a bent spring formed from flat metal narrower than said rectangular hollow and having two arms connected by a central bend of normally less than 180°, whereby said spring when uncompressed extends said arms wider than the sleeve hollows, and downward movement of the sleeve relative to said spring presses the spring arms towards each other, said arms terminating in opposing grasping portions at least one of which is curved inwardly, whereby to permit relative angular movement about a curved base element grasped by it, at least one of said arms further having an inward projecting stop at the inward extremity of said grasping portion, said connector means further comprising a fixed retention bolt adjacent to the bottom opening of said sleeve and extending between the arms of said spring horizontally across the interior width of said sleeve, whereby to retain said spring bend when said spring arms project from each said bottom opening of each sleeve, said connector means further having spring latch means, operable by downward movement of said sleeve relative to said spring bend, to releasably retain said spring in such position wherein only its grasping portions project below said bottom opening of said sleeve, whereby said grasping portions, closed on a rounded base element, may pivot thereabout to accommodate changes in the angular relationship between said seat sockets and said seat platform.

* * * * *

UNITED STATES PATENT AND TRADEMARK OFFICE

CERTIFICATE OF CORRECTION

PATENT NO. : 5,042,614

DATED : August 27, 1991

INVENTOR(S) : Rainey, Robert P.

It is certified that error appears in the above-identified patent and that said Letters Patent is hereby corrected as shown below:

Col. 3, line 8, delete "22, 22'" and substitute ---24, 24'---.

Col. 5, line 51, after "64'" delete "a".

Signed and Sealed this

Twenty-second Day of December, 1992

*Attest:*

DOUGLAS B. COMER

*Attesting Officer*

*Acting Commissioner of Patents and Trademarks*